US005443044A

United States Patent [19]

VanRens

[11] Patent Number: 5,443,044

[45] Date of Patent: Aug. 22, 1995

[54] OUTBOARD MOTOR WITH FOUR STROKE ENGINE

[75] Inventor: Russell J. VanRens, Milwaukee, Wis.

[73] Assignee: Outboard Marine Corporation, Waukegan, Ill.

[21] Appl. No.: 235,502

[22] Filed: Apr. 29, 1994

[51] Int. Cl.[6] ..... F02F 7/00; B63H 20/14

[52] U.S. Cl. ..... 123/195 HC; 123/196 W

[58] Field of Search ..... 123/196 W, 195 HC, 195 P; 440/84, 49

[56] References Cited

U.S. PATENT DOCUMENTS

| | | | |
|---|---|---|---|
| 4,173,939 | 11/1979 | Strang | 115/17 |
| 4,588,385 | 7/1986 | Suzuki et al. | 440/88 |
| 4,726,799 | 2/1988 | Harada et al. | 440/76 |
| 4,781,635 | 11/1988 | Kinouchi et al. | 440/75 |
| 5,036,805 | 8/1991 | Yamamoto et al. | 123/59.5 |
| 5,049,100 | 9/1991 | Yamamoto et al. | 440/77 |
| 5,383,440 | 1/1995 | Koishikawa et al. | 123/196 W |

FOREIGN PATENT DOCUMENTS 5-26020 2/1993 Japan .

*Primary Examiner*—David A. Okonsky

*Attorney, Agent, or Firm*—Michael, Best & Friedrich

[57] ABSTRACT

Disclosed herein is an outboard motor comprising a steerable and tiltable propulsion unit including a lower unit including a vertically extending drive shaft housing, a drive shaft extending vertically in the drive shaft housing and located in a plane extending in a fore and aft direction, and a propeller shaft driven by the drive shaft and extending in the fore and aft plane, and a powerhead comprising a four stroke engine including a vertically extending crankshaft located forwardly of the drive shaft and in laterally spaced relation to the fore and aft plane, a cylinder extending horizontally and radially from the crankshaft and at an acute angle to the fore and aft plane, a camshaft extending generally vertically in the fore and aft plane and in vertical alignment with and in driving connection with the drive shaft, and a gear set drivingly connecting the crankshaft and the camshaft for rotatably driving the camshaft at a rotational speed which is one-half of the rotational speed of the crankshaft.

11 Claims, 1 Drawing Sheet

OUTBOARD MOTOR WITH FOUR STROKE ENGINE

BACKGROUND OF THE INVENTION

The invention relates generally to marine propulsion devices and, more particularly, to outboard motors including internal combustion engines. Still more particularly, the invention relates to outboard motors including four stroke internal combustion engines.

Attention is directed to the following U.S. Pat. Nos.:

| U.S. Pat. No. | Inventor(s) | Issue Date |
|---|---|---|
| 4,173,939 | Charles D. Strang | 11/13/79 |
| 4,781,635 | Sosuke Kinouchi | 11/1/88 |

Attention is also directed to Japanese Application No. 3-206473, filed Jul. 23, 1991.

SUMMARY OF THE INVENTION

This invention provides an outboard motor comprising a steerable and tiltable propulsion unit including a lower unit including a vertically extending drive shaft housing, a drive shaft extending vertically in the drive shaft housing and located in a plane extending in a fore and aft direction, and a propeller shaft driven by the drive shaft and extending in the fore and aft plane, and a powerhead comprising a four stroke engine including a vertically extending crankshaft, a cylinder extending horizontally and radially from the crankshaft and at an acute angle to the fore and aft plane, a camshaft extending generally vertically in the fore and aft plane and in vertical alignment with and in driving connection with the drive shaft, and means drivingly connecting the crankshaft and the camshaft for rotatably driving the camshaft at a rotational speed which is one-half of the rotational speed of the crankshaft.

The invention also provides an outboard motor comprising a steerable and tiltable propulsion unit including a lower unit including a vertically extending drive shaft housing, a drive shaft extending vertically in the drive shaft housing and located in a plane extending in a fore and aft direction, and a propeller shaft driven by the drive shaft and extending in the fore and aft plane, and a powerhead comprising a four stroke engine including a vertically extending crankshaft, a cylinder extending horizontally and radially from the crankshaft and at an acute angle to the fore and aft plane, a camshaft extending generally vertically in the fore and aft plane and in vertical alignment with and in driving connection with the drive shaft, and means drivingly connecting the crankshaft and the camshaft for rotatably driving the camshaft at a rotational speed which is one-half of the rotational speed of the crankshaft.

The invention also provides an outboard motor comprising a steerable and tiltable propulsion unit including a lower unit including a vertically extending drive shaft housing, a drive shaft extending vertically in the drive shaft housing and located in a plane extending in a fore and aft direction, and a propeller shaft driven by the drive shaft and extending in the fore and aft plane, and a powerhead comprising a four stroke engine including a vertically extending crankshaft located forwardly of the drive shaft and in laterally spaced relation to the fore and aft plane, a cylinder extending horizontally and radially from the crankshaft and at an acute angle to the fore and aft plane, a camshaft extending generally vertically in the fore and aft plane and in vertical alignment with and in driving connection with the drive shaft, and means drivingly connecting the crankshaft and said camshaft for rotatably driving the camshaft at a rotational speed which is one-half of the rotational speed of the crankshaft.

Other features and advantages of the invention will become apparent to those skilled in the art upon review of the following detailed description, claims and drawings.

Figure 1:
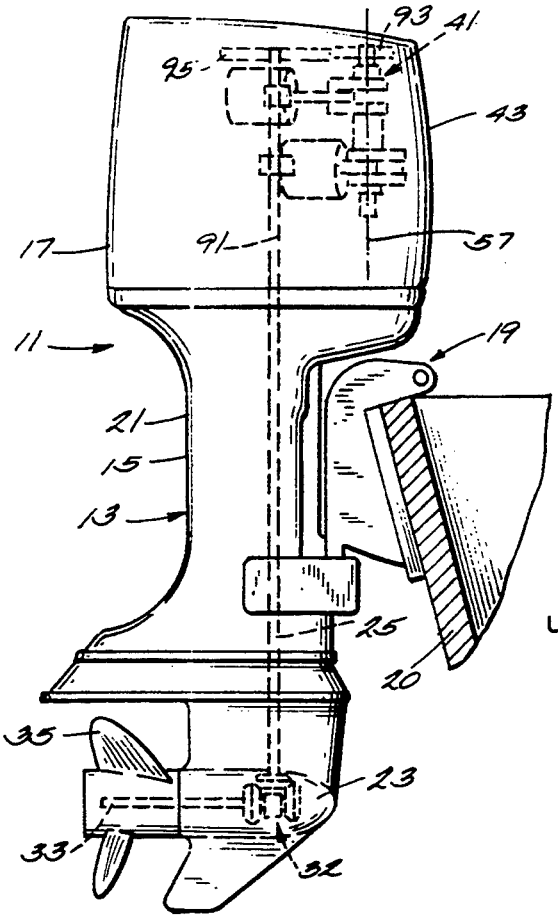
FIG. 1 is a side elevation view of an outboard motor embodying various of the features of the invention.

Before explaining one embodiment of the invention in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

The outboard motor 11 shown in FIG. 1 includes a steerable and tiltable propulsion unit 13 comprising a lower unit 15, and a powerhead 17, together with any suitable means 19 for securing the propulsion unit 13 to the aft portion 20 of a boat for steering and tilting movement of the propulsion unit 13 relative to the boat.

The lower unit 15 includes a drive shaft housing 21 having a lower end to which a gear case housing 23 is connected. Located in the drive shaft housing 21 is a drive shaft 25 which extends vertically in a fore and aft plane 31 (see FIG. 2) and which, at its lower end, is drivingly connected, preferably through a reversing transmission 32, to a propeller shaft 33 which is rotatably supported by the gear case housing 23 in the fore and aft plane 31 and which carries a propeller 35 or other suitable propulsion device.

The powerhead 17 includes a four stroke internal combustion engine 41 which is rigidly mounted on the top of the drive shaft housing 21 and which, in general, is enclosed by a suitable cowl 43. As thus far disclosed the construction is conventional.

Figure 2:
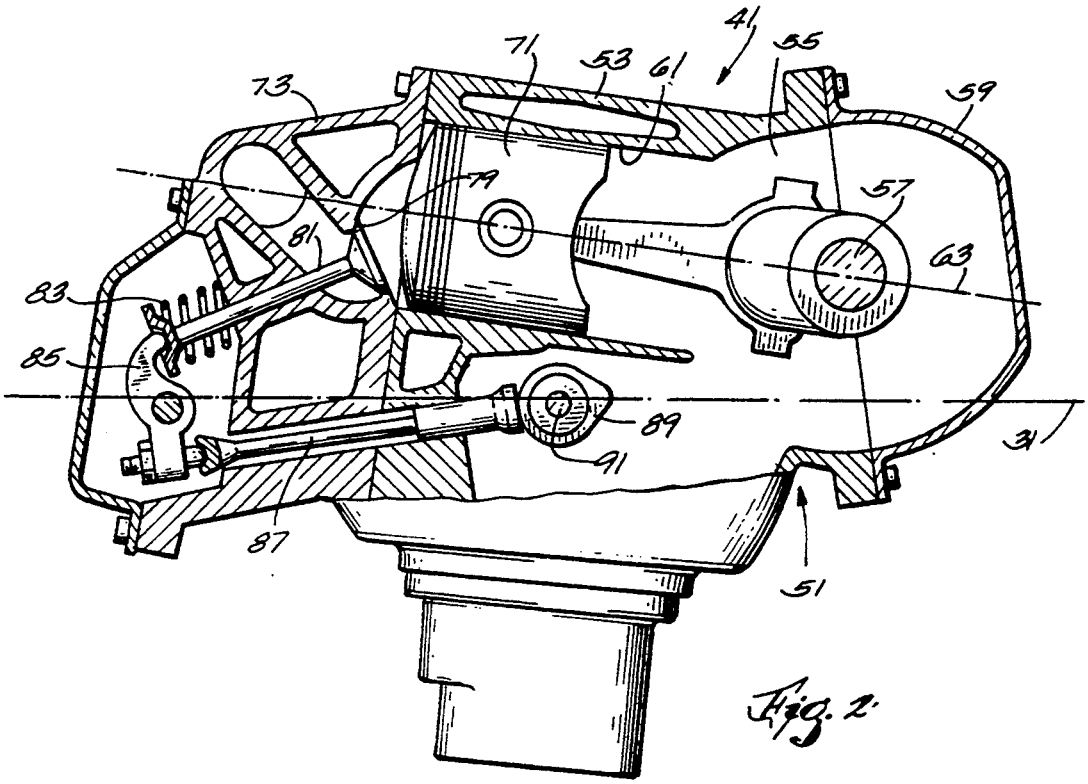
FIG. 2 is an enlarged and fragmentary sectional view of a four stroke internal combustion engine incorporated in the outboard motor shown in FIG. 1.

The internal combustion engine 41 comprises, as best shown in FIG. 2, an engine block 51 including a cylinder block 53 which, at least in part, defines a crankcase 55 which suitably rotatably supports a crankshaft 57 which extends vertically in laterally spaced relation to the fore and aft plane 31 and which is located forwardly of the drive shaft 25. The crankcase 55 can be closed or completed by a crankcase cover 59.

The cylinder block 53 also defines a cylinder 61 which surrounds a cylinder axis 63 extending horizontally and radially from the crankshaft 57 and at an acute angle to the fore and aft plane 31 such that the head end of the cylinder 61 is located more remotely from the fore and aft plane 31 than the crankcase end.

Located in the cylinder 61 is a piston 71 which is connected to the crankshaft 57 such that reciprocation of the piston 71 causes rotation of the crankshaft 57.

The engine block 51 also includes a cylinder head 73 which is suitably connected to the cylinder block 53, which includes an inclined surface which, in part, defines a combustion chamber, and which includes a spaced inlet and exhaust valve seats 79 (only one shown). Reciprocally movable relative to the valve seats 79 are inlet and exhaust valves 81 (only one shown) which are movably supported by the cylinder head 73, which are biased into engagement with the valve seats 79 by suitable respective springs 83 (only one shown), and which are displaced from the valve seats 79 by suitable respective rocker arms 85 (only one shown) which are suitably supported for pivotal movement by the head 73.

The rocker arms 85 are displaced to lift the valves 81 off the valve seats 79 in timed relation to piston movement by respective push rods 87 (only one shown) which are suitably guided for movement by the engine block 51 and which, at one end, respectively engage the rocker arms 85 and which, at the other end, engage lobes 89 (only one shown) on a camshaft 91 which is suitably supported for rotation by the engine block 51.

The camshaft 91 extends generally vertically in the fore and aft plane 31 in coaxial relation to the drive shaft 25 and is drivingly connected thereto by any suitable means.

The camshaft 91 is rotatably driven at one-half the rotational speed of the crankshaft 57 by enmeshed timing gears 93 and 95 respectively fixedly mounted on the crankshaft 57 and the camshaft 91. Thus, the drive shaft 25 is driven at camshaft rotational speed, thereby permitting rotation of the crankshaft 57 at twice the speed of the drive shaft 25. Such faster crankshaft rotation affords power generation from engine parts which are smaller and, accordingly, of lesser weight, without requiring another auxiliary gear set between the crankshaft 57 and the drive shaft 25. In addition, taking power from the camshaft 91 of a push rod engine desirably places the drive shaft 25 nearer to the fore and aft center of gravity of the outboard motor 11.

In addition, angling of the axis 63 of the cylinder 61 bore serves to permit reduction in the volume enclosed within the cowling 43, thereby providing a smaller powerhead.

The engine 41 can be constructed as additionally explained in application Ser. No. 08/245,977 (attorney's docket 72012/2540- E-2384) filed May 19, 1994, and assigned to the assignee of this application which application is incorporated herein by reference. As a consequence the lubrication system disclosed therein can be employed with the construction disclosed herein.

Various of the features of the invention are set forth in the following claims.

I claim:

1. An outboard motor comprising a steerable and tiltable propulsion unit including a lower unit including a vertically extending drive shaft housing, a drive shaft extending vertically in said drive shaft housing and located in a plane extending in a fore and aft direction, and a propeller shaft driven by said drive shaft and extending in said fore and aft plane, and a powerhead comprising a four stroke engine including a vertically extending crankshaft, a cylinder extending horizontally and radially from said crankshaft and in a vertical cylinder plane other than said fore and aft plane, a camshaft extending generally vertically in said fore and aft plane and in driving connection with said drive shaft, and means drivingly connecting said crankshaft and said camshaft for rotatably driving said camshaft at a rotational speed which is one-half of the rotational speed of said crankshaft.

2. An outboard motor in accordance with claim 1 wherein said cylinder plane extends at an acute angle to said fore and aft plane.

3. An outboard motor comprising a steerable and tiltable propulsion unit including a lower unit including a vertically extending drive shaft housing, a drive shaft extending vertically in said drive shaft housing and located in a plane extending in a fore and aft direction, and a propeller shaft driven by said drive shaft and extending in said fore and aft plane, and a powerhead comprising a four stroke engine including a vertically extending crankshaft located forward of said drive shaft, a camshaft extending generally vertically in said fore and aft plane and driving said drive shaft, and means drivingly connecting said crankshaft and said camshaft for rotatably driving said camshaft at a rotational speed which is one-half of the rotational speed of said crankshaft.

4. An outboard motor in accordance with claim 3 wherein said crankshaft is in laterally spaced relation to said fore and aft plane.

5. An outboard motor comprising a steerable and tiltable propulsion unit including a lower unit including a vertically extending drive shaft housing, a drive shaft extending vertically in said drive shaft housing and located in a plane extending in a fore and aft direction, and a propeller shaft driven by said drive shaft and extending in said fore and aft plane, and a powerhead comprising a four stroke engine including a vertically extending crankshaft located forwardly of said drive shaft and in laterally spaced relation to said fore and aft plane, a cylinder extending horizontally and radially from said crankshaft and at an acute angle to said fore and aft plane, a camshaft extending generally vertically in said fore and aft plane and in vertical alignment with and in driving connection with said drive shaft, and means drivingly connecting said crankshaft and said camshaft for rotatably driving said camshaft at a rotational speed which is one-half of the rotational speed of said crankshaft.

6. An outboard motor in accordance with claim 1 wherein said camshaft is coaxial with said drive shaft.

7. An outboard motor in accordance with claim 1 wherein said crankshaft is located forward of said drive shaft.

8. An outboard motor in accordance with claim 7 wherein said crankshaft is located in laterally spaced relation to said fore and aft plane.

9. An outboard motor in accordance with claim 3 wherein said camshaft is coaxial with said drive shaft.

10. An outboard motor in accordance with claim 3 and further comprising a cylinder extending horizontally and radially from said crankshaft and in a vertical cylinder plane other than said fore and aft plane.

11. An outboard motor in accordance with claim 10 wherein said cylinder plane extends at an acute angle to said fore and aft plane.

* * * * *